US006142467A

United States Patent [19]

Funada

[11] Patent Number: 6,142,467

[45] Date of Patent: Nov. 7, 2000

[54] SHEET FEEDER HAVING AN INTERMITTENT COUPLING MEMBER

[75] Inventor: Takumi Funada, Niigata, Japan

[73] Assignee: NEC Corporation, Tokyo, Japan

[21] Appl. No.: 09/005,837

[22] Filed: Jan. 12, 1998

[30] Foreign Application Priority Data

Jan. 14, 1997 [JP] Japan ..... 9-004409
Feb. 25, 1997 [JP] Japan ..... 9-040497

[51] Int. Cl.[7] ..... B65H 9/04

[52] U.S. Cl. ..... 271/246; 271/10.13; 271/10.04; 271/226; 271/242

[58] Field of Search ..... 271/16, 10.04–10.12, 271/10.13, 226, 242, 246

[56] References Cited

U.S. PATENT DOCUMENTS

| | | | |
|---|---|---|---|
| 4,577,849 | 3/1986 | Watanabe | 271/10.13 X |
| 4,941,655 | 7/1990 | Winkler | 271/242 |
| 5,255,903 | 10/1993 | Parsons et al. | 271/10.12 |
| 5,284,064 | 2/1994 | Green et al. | 74/435 |
| 5,579,129 | 11/1996 | Iwata et al. | 271/10.12 X |
| 5,755,435 | 5/1998 | Fujiwara | 271/10.04 X |
| 5,860,645 | 1/1999 | Tomura et al. | 271/10.04 X |
| 5,863,036 | 1/1999 | Tanaka et al. | 271/10.13 X |
| 5,947,465 | 9/1999 | Kato et al. | 271/242 X |

FOREIGN PATENT DOCUMENTS

| | | |
|---|---|---|
| 60-236938 | 11/1985 | Japan . |
| 62-215437 | 9/1987 | Japan . |
| 62-215439 | 9/1987 | Japan . |
| 62-227670 | 10/1987 | Japan . |
| 63-68543 | 5/1988 | Japan . |
| 3-272950 | 12/1991 | Japan . |
| 4144764 | 5/1992 | Japan . |
| 6-872245 | 3/1994 | Japan . |
| 6-106831 | 4/1994 | Japan . |
| 6-263274 | 9/1994 | Japan . |
| 6-323392 | 11/1994 | Japan . |
| 7-156518 | 6/1995 | Japan . |

*Primary Examiner*—Christopher P. Ellis
*Assistant Examiner*—Patrick Mackey
*Attorney, Agent, or Firm*—Foley & Lardner

[57] ABSTRACT

A sheet feeder in a printer has a sheet loader, a pickup roller for feeding a cut sheet from the sheet loader, and a sheet feed roller for feeding the cut sheet supplied from the pickup roller for printing thereon data by a printing head. The pickup roller first feeds the cut sheet toward the sheet feed roller which rotates in a reverse direction, whereby the leading edge of the cut sheet is abut to the sheet feed roller. The pickup roller is then stopped and released from the cut sheet whereby a skew of the cut sheet is corrected. Subsequently, the sheet feed roller rotates in the forward direction to feed the cut sheet.

8 Claims, 6 Drawing Sheets

SHEET FEEDER HAVING AN INTERMITTENT COUPLING MEMBER

BACKGROUND OF THE INVENTION (a) Field of the Invention

The present invention relates to a sheet feeder having an intermittent coupling member and, more particularly, an improvement of a sheet feeder suitable for use in an imaging device such as a printer. The present invention also relates to a method for controlling such a sheet feeder and a cut-out gear suitable for use in the sheet feeder.

(b) Description of the Related Art

A conventional sheet feeder for use in a printer is described in Patent Publication No. JP-A-62(1987) -215437, for example. The described sheet feeder comprises a pickup roller and a gear train including a sun and planet gear receiving a driving force from a platen gear and a cut-out gear having a part of lacking teeth for effecting an idling state in the mechanical coupling. A specified amount of rotation in a forward rotation of the platen gear is transmitted to the pickup roller through the gear train after a reverse rotation of the platen.

FIG. 1 shows the conventional sheet feeder as mentioned above, wherein the sheet feeder comprises a first idle gear 141 engaged with a gear 148 fixed to a platen shaft 152, a second idle gear 142 constituting a planet gear linked with the shaft of the first idle gear 141, a third idle gear 143 engaged with the first idle gear 141, a fourth idle gear 144 co-axially fixed to the third idle gear 143, a fifth idle gear 145 engaged with the fourth idle gear 144, a pickup roller gear 146 engaged with the fifth idle gear 145 and co-axially fixed to a pickup roller 151 disposed for feeding a cut sheet 160 from a pile of cut sheets.

The third idle gear 143 and the fourth idle gear 144 have respective cut-out portions 153 or lacking teeth parts, which are opposed to each other. The lacking teeth part 153 of the third idle gear 143 disengages the third idle gear 143 with the fourth idle gear 144 after the engagement of the fourth idle gear 144 and the fifth idle gear 145 is finished due to the lacking teeth part of the fourth idle gear 144.

In operation, the gear train is subjected to a reverse rotation designated by arrow "b", after some forward rotation designated by arrow "a", to engage the gear train. The gear train allows the pickup roller 151 first to feed the cut sheet 160 in the reverse direction up to the position behind the platen shaft 152 and then to feed the cut sheet 160 in the forward direction, thereby feeding the cut sheet 160 from the sheet feeder.

In the above conventional sheet feeder, a skew of the cut sheet is not corrected unless the operator of the printer corrects after stopping the sheet feeder.

SUMMARY OF THE INVENTION

In view of the foregoing, it is an object of the present invention to provide a sheet feeder having an intermittent coupling member which is capable of correcting the skew of the cut sheet.

It is another object of the present invention to provide a method for controlling the sheet feeder as mentioned above and a cut-out gear suitable for use therein.

The present invention provides, in a first aspect thereof, a sheet feeder comprising a sheet feeder comprising a sheet loader for mounting thereon a pile of cut sheets, a pickup roller for transferring the cut sheets, a thrust member for intermittently thrusting the sheet loader and the pile of cut sheets against the pickup roller, a sheet feed roller for transferring the cut sheets transferred by the pickup roller, a feed motor, and a coupling section for coupling the feed motor and the sheet feed roller for rotation of the sheet feed roller and for intermittently coupling the feed motor and the thrusting member for effecting the intermittent thrusting by the thrust member.

The present invention also provides, in a second aspect thereof, a method for controlling a sheet feeder comprising a sheet loader for mounting thereon a pile of cut sheets on the sheet loader, a pickup roller for transferring the cut sheets, a sheet feed roller for transferring the cut sheets transferred by the pickup roller, the method comprising consecutively the steps of:

rotating the pickup roller to feed the cut sheet toward the sheet feed roller while the sheet feed roller rotates in a reverse direction;

stopping the pickup roller while the sheet feed roller rotates in the reverse direction; and rotating the sheet feed roller in a forward direction to feed the cut sheet.

In accordance with the sheet feeder and method for controlling the same according to the present invention, skew of the sheet feeder can be corrected during the reverse rotation of the sheet feed roller and the forward rotation of the pickup roller.

The present invention further provides, in a third aspect thereof, a cut-out gear comprising on an outer periphery thereof a teeth part having teeth thereon for engagement with another gear, a lacking teeth part having substantially no teeth thereon for engagement with the another gear, and an overhang overhanging a portion of the lacking teeth part and having teeth thereon extending from the teeth of the teeth part toward a radially outward direction.

In accordance with the cut-out gear of the present invention, the teeth on the overhang is free from continuous hitting by the teeth of the another gear. As a result, mechanical damage for the teeth of the cut-out gear can be reduced.

The above and other objects, features and advantages of the present invention will be more apparent from the following description, referring to the accompanying drawings.

PREFERRED EMBODIMENTS OF THE INVENTION

Figure 1:
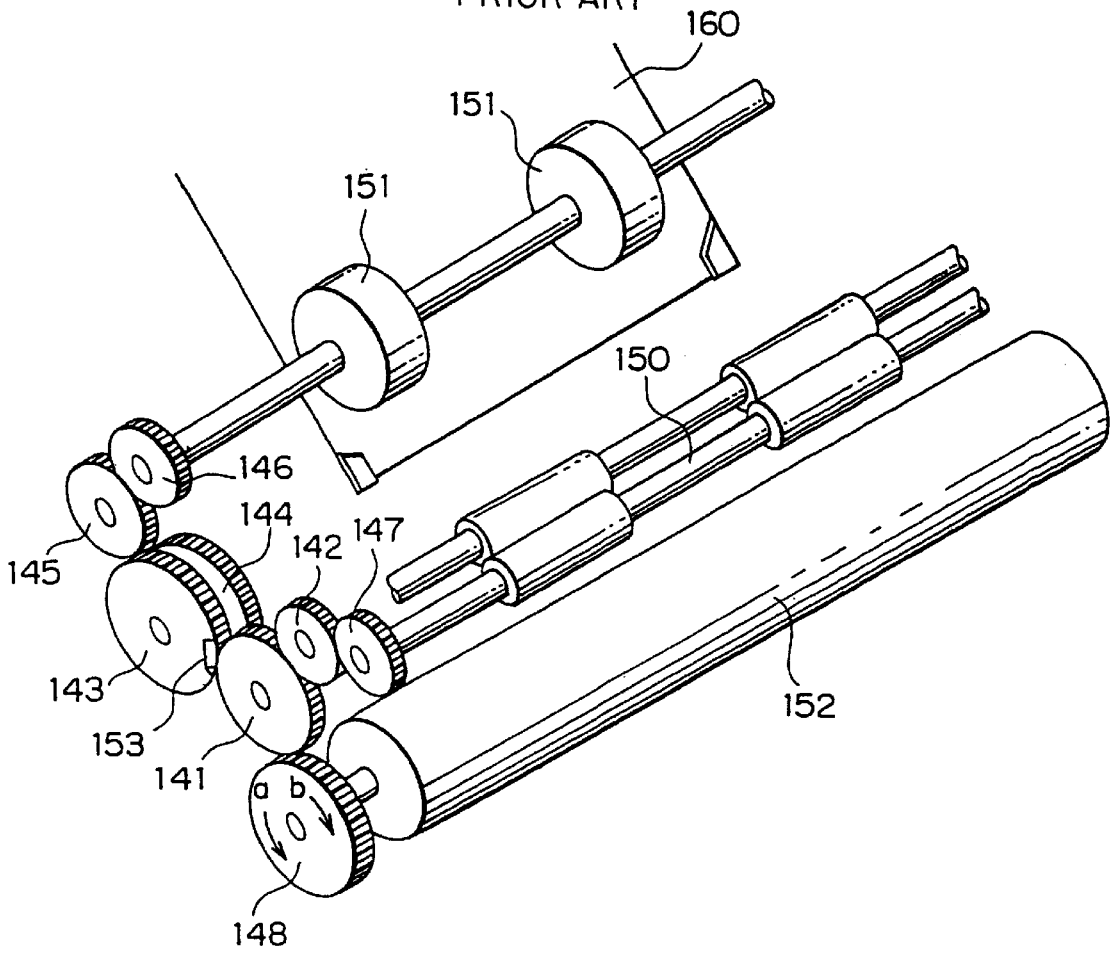
FIG. 1 PRIOR ART
FIG. 1 is a schematic perspective view of a conventional sheet feeder used in a printer.
Figure 2:
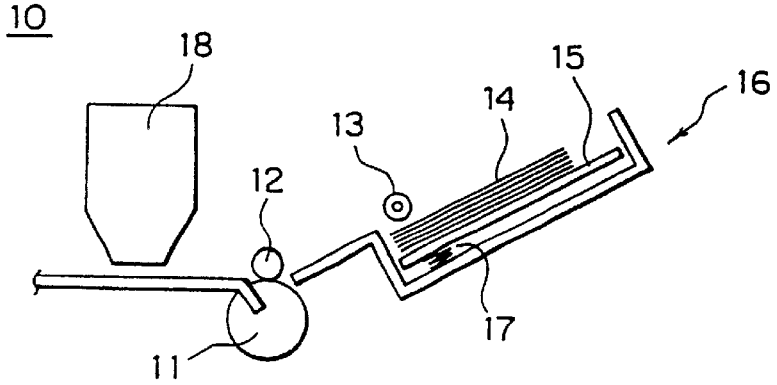
FIG. 2 is a schematic side view of a printer comprising a sheet feeder according to a first embodiment of the present invention.

Referring to FIG. 2, the printer generally designated by numeral 10 comprises a sheet feeder 16 according to a first embodiment of the present invention, a pair of sheet feed roller 11 and press roller 12 for transferring a cut sheet supplied from the sheet feeder 16, and a carriage 18 mounting thereon a printing head for printing data on the cut sheet supplied from the pair of rollers 11 and 12.

The sheet feeder 16 comprises a sheet loader 15 for mounting thereon a sheet pile or pile of cut sheets 14, a pickup roller 13 for transferring the top cut sheet disposed on top of the sheet pile 14, a spring 17 for urging or thrusting the sheet loader 15 together with the sheet pile 14 against the pickup roller 13, and a gear train (not shown in FIG. 2) for controlling the operation of the sheet feeder 16.

Figure 3A:
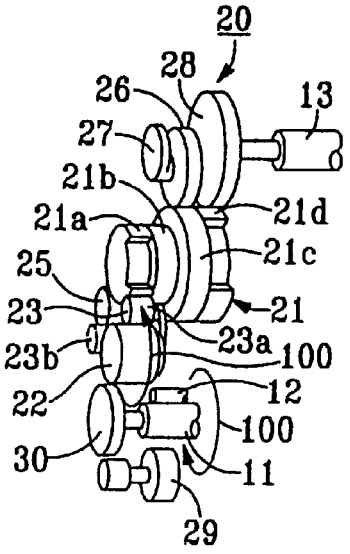
FIGS. 3*a* and 3*b* schematic perspective views of the gear train in the sheet feeder shown in FIG. 2.
Figure 3B:
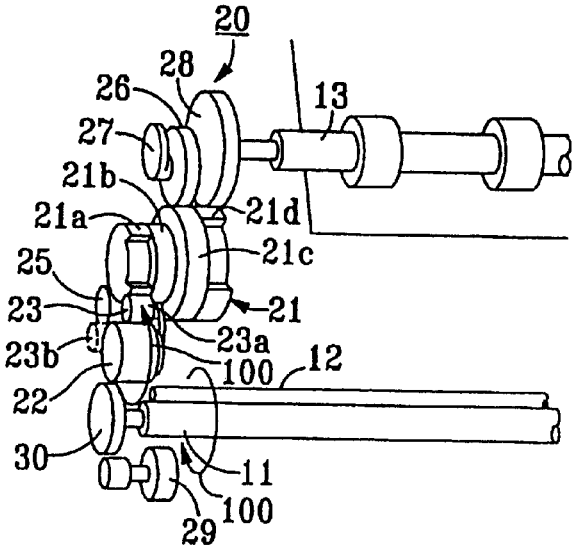

Referring to FIG. 3, the gear train 20 in the sheet feeder 16 comprises a roller gear 30, driven by a feed motor or drive motor 29, for rotating the sheet feed roller 11 and the press roller 12, a sun and planet gear including a sun gear 22 driven by the roller gear 30, an idle gear 25 and a planet gear 23, a timing gear 21 driven by the sun and planet gear, a cam gear 26, driven by the timing gear 21, for controlling a cam 27, and a pickup roller gear 28, driven by the timing gear 21, for rotating the pickup roller 13.

Figure 4:
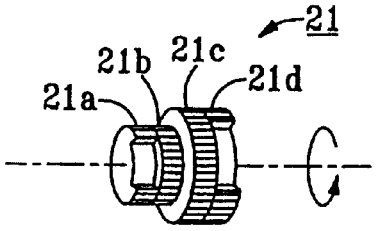
FIG. 4 is a perspective view of the timing gear in the gear train of FIG. 3.

Referring additionally to FIG. 4, the timing gear 21 comprises a first gear section 21*a* having a part of lacking teeth (or lacking teeth part) for receiving a forward driving force from the planet gear 23 for a specified amount of rotation, a second gear section 21*b* for receiving a reverse driving force from the idle gear 25, a third gear section 21*c* for driving the cam gear 26, and a fourth gear section 21*d*, having a pair of lacking teeth parts, for intermittently driving the pickup roller gear 28. The first through fourth gear sections 21*a* to 21*d* are fixed to one another for rotation in unison.

Figure 5:
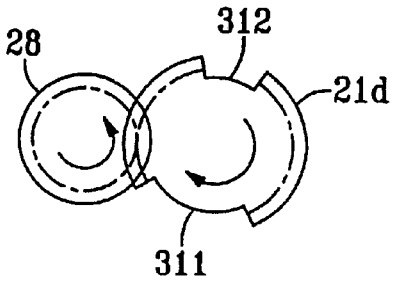
FIG. 5 is a front view of the timing gear in FIG. 4.

Referring to FIG. 5, the fourth gear section 21*d* of the timing gear 21 has a first lacking teeth part 311 for intercepting the driving force applied to the pickup roller gear 28 prior to the transferring of a cut sheet and a second lacking teeth part 312 for intercepting the driving force applied to the pickup roller gear 28, after the skew of the cut sheet is corrected while the forward edge of the cut sheet is being abut against the sheet feed roller 11.

Figure 6A:
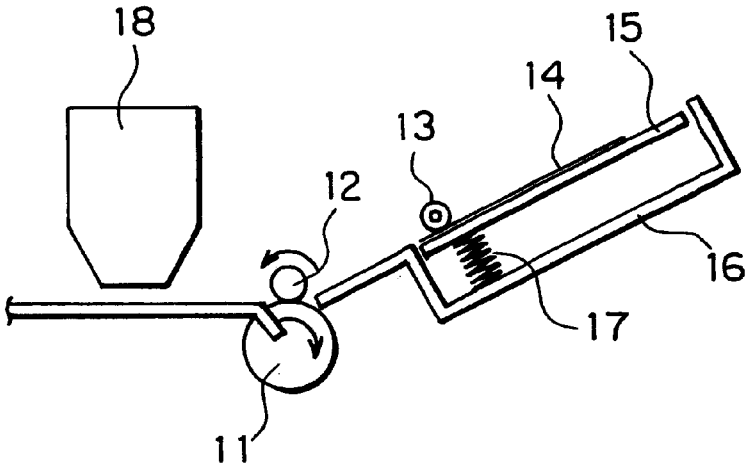
FIGS. 6A to 6D are schematic side views of the sheet feeder shown in FIG. 2 in consecutive steps of operation.
Figure 6B:
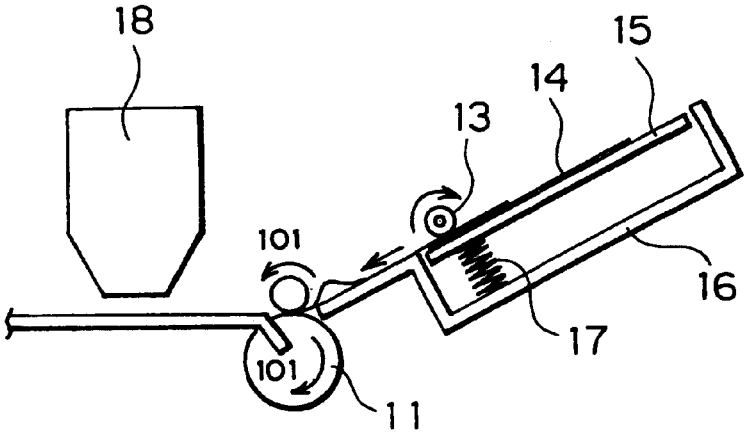
Figure 6C:
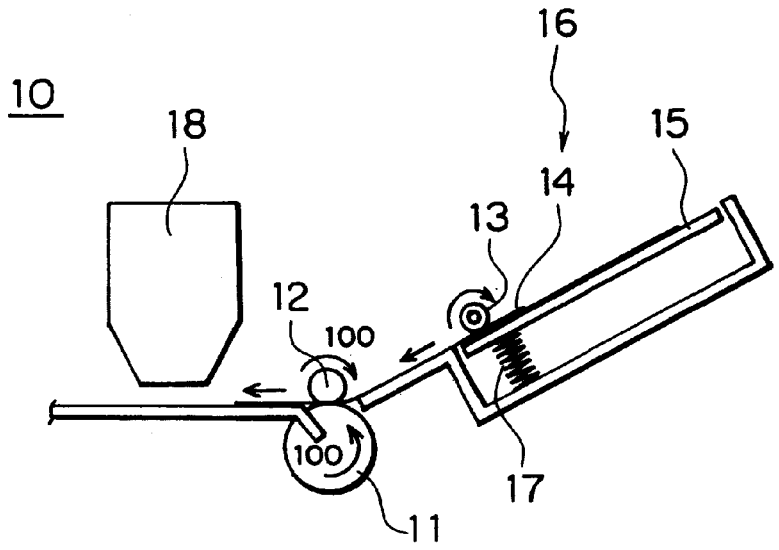
Figure 6D:
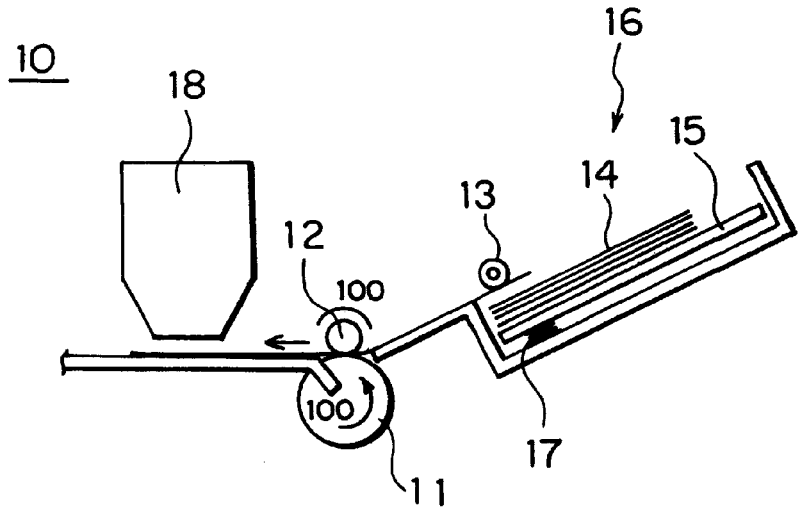
Figure 7:
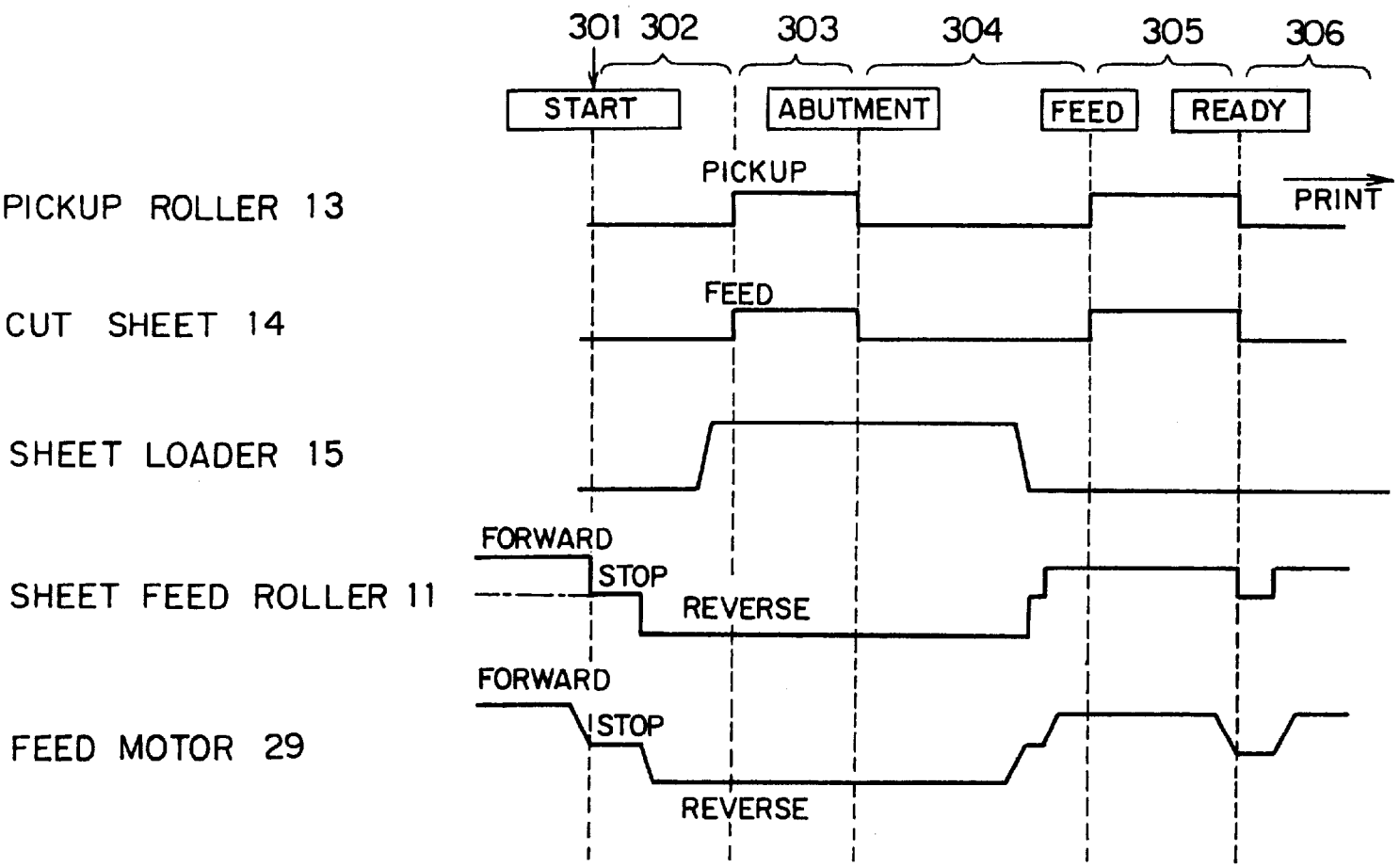
FIG. 7 is a timing chart of the printer of FIG. 2.

Now, the detailed operation of the sheet feeder of the present embodiment will be described with reference to FIGS. 6A to 6D showing consecutive steps of the operation of the sheet feeder and FIG. 7 showing a timing chart thereof, in addition to FIGS. 2 and 3.

In FIG. 3, prior to the sheet feed operation, the feed motor 29 first rotates the roller gear 30 together with the sheet feed roller 11 in the forward direction designated by arrow 100 for more than a fixed amount of rotation, thereby revolving the planet gear 23 around the sun gear 22 to reside into a home position 23*a* (shown by a solid line in FIG. 3), at which the driving force from the feed motor 29 to the cam gear 26 and the pickup roller gear 28 is intercepted by the lacking teeth part 21*a* of the first gear section 21*a*. In this position, the pickup roller 13 resides in an idling state because the pickup roller gear 28 is positioned at the first lacking teeth part 311 of the fourth gear section 21*d*. In this position, the sheet feeder is in a waiting mode shown by numeral 301 in FIG. 7, wherein the pickup roller 13 resides in a stationary state, and the sheet loader 15 is thrust downward against the spring 17, as shown in FIG. 2, by the cam 27 so that the sheet pile 14 is not in contact with the pickup roller 13. Further, the sheet feed roller 11 and the feed motor 29 are stopped.

Turning back to FIG. 3, when the feed motor 29 rotates the sheet feeder 11 in the reverse direction opposite to the direction designated by 100 in step 302, the sun gear 22 revolves the planet gear 23 therearound and renders the planet gear 23 into the operating position 23*b* shown by the broken line. The planet gear 23 in this position transmits the driving force from the sun gear 22 through the idle gear 25 and the second gear section 21*b* to the cam gear 26, which rotates the cam 27 for releasing the sheet loader 15 from the cam 27 into an operating position, as shown in FIG. 6A. This step is shown by numeral 302 in FIG. 7, wherein the pickup roller 13 and cut sheet 14 still remain in the stationary state, the feed motor 29 starts for rotation in the reverse direction to rotates the sheet feed roller 11 in a reverse direction as a reverse change-line mode, as shown in FIG. 6A. The sheet loader 15 and the sheet pile 14 are thrust against the pickup roller 13. In this step, the pickup roller 13 still remains in the stationary state by the function of the first lacking teeth part 311 of the fourth gear section 21*d* of the timing gear 21.

The feed motor 29 continues rotation in the reverse direction to rotate the sheet feeder 11 and engage the pickup roller gear 28 with the fourth gear section 2*d* after passing the first lacking teeth part 311. As a result, the pickup roller 13 starts for rotation in its forward direction to pick up and feed the top cut sheet 14 in the forward direction, as shown in FIG. 6B. The leading edge of the top sheet 14 is then abut against the sheet feed roller 11 which stays in its reverse rotation, whereby the top cut sheet 14 is slackened by the sheet feed roller 11, and the skew of the leading edge of the cut sheet 14 is corrected. In this step, shown by numeral 303 in FIG. 7, the pickup roller 13 rotates in a forward direction for feeding the top cut sheet in a change-line mode, and the sheet loader 15 as well as the feed motor 29 and the sheet feed roller 11 remains in the same state as in the state in step 302.

Subsequently, while the feed motor 29 still rotates the sheet feed roller 11 in the reverse direction, the sheet loader 15 is thrust against the spring 17 by the function of the cam 27 in step 304, whereby the top cut sheet is released from the pickup roller 13 and the skew of the trailing edge of the cut sheet 14 is corrected. In this step, shown by numeral 304 in FIG. 7, the pickup roller 13 shifts into an idling state by the function of the second lacking teeth part 312 of the fourth gear section 21*d* of the timing gear 21.

Referring to FIG. 6C, when the feed motor 29 reverses the rotation of the sheet feeder 11 into a forward rotation 100 in step 304, the driving force is also transmitted to the pickup roller 13 through the fourth gear section 21*d* of the timing gear 21 which has exceeded the second lacking teeth part 312. Since the sheet feed roller 11 now rotates in the forward direction 100, the pickup roller 13 rotating also in its forward direction advances the top sheet 14 by passing between the sheet feed roller 11 and the press roller 12, thereby feeding the top cut sheet 14 to a starting position of the cut sheet, wherein the cut sheet stays for waiting the start of recording. After the cut sheet 14 reaches the starting position thereof, the timing gear 21 stays in the home position where the planet gear 23 stays at the lacking teeth part of the first gear section 21*a*. The sheet loader 15 is thrust against the spring by the cam 27 to release the top sheet from the pickup roller 13. This step is designated by numeral 305 in FIG. 7, which is followed by step 306 for printing data onto the cut sheet by the printing head carried by the carriage 18 while feeding the cut sheet in the forward direction by the sheet feed roller 11, as shown in FIG. 6D.

In the present embodiment, by using the timing gear 21 and the combination of cam 27 and spring 17, the forward rotation and the reverse rotations of the sheet feed roller 11 provide an effective correction of sheet skew. The configuration also provides a reduction in the load for the feed motor because the pickup roller is in an idling state during a printing mode of the printer.

Figure 8A:
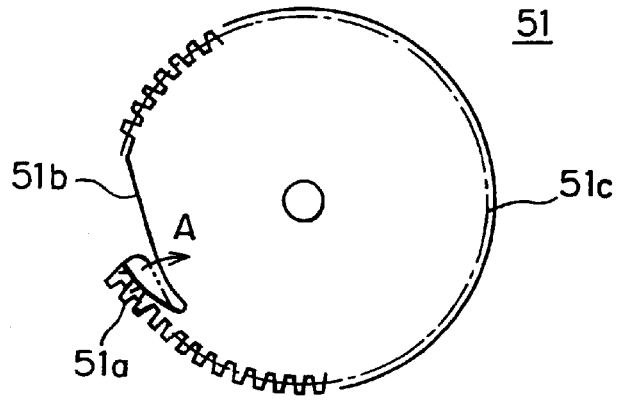
FIG. 8A is a front view of a cut-out gear used in a sheet feeder according to a second embodiment of the present invention.

Referring to FIG. 8A showing the configuration of a cut-out gear in a sheet feeder according to a second embodiment of the present invention, the cut-out gear 51 has, in addition to an ordinary teeth part 51*c*, a lacking teeth part 51*b* formed by cut-out of the outer periphery of the gear 51, and an overhang 51*a* disposed adjacent to the lacking teeth part 51*b* and hanging over a portion of the lacking teeth part 51*b* from the leading edge of the lacking teeth part 51*b*.

The overhang 51*a* has teeth aligned with the teeth of the ordinary teeth part 51*c* and extending in the radially outward direction compared to the teeth of the ordinary teeth part 51*c*. The overhang 51*a* can be bent, as shown by the dotted line in FIG. 8A, to have a smaller diameter than the pitch circle of the ordinary teeth part 51*c*, when the gear 51 is engaged with a driving gear, due to the elasticity or spring function of the overhang 51*a*.

Figure 8B:
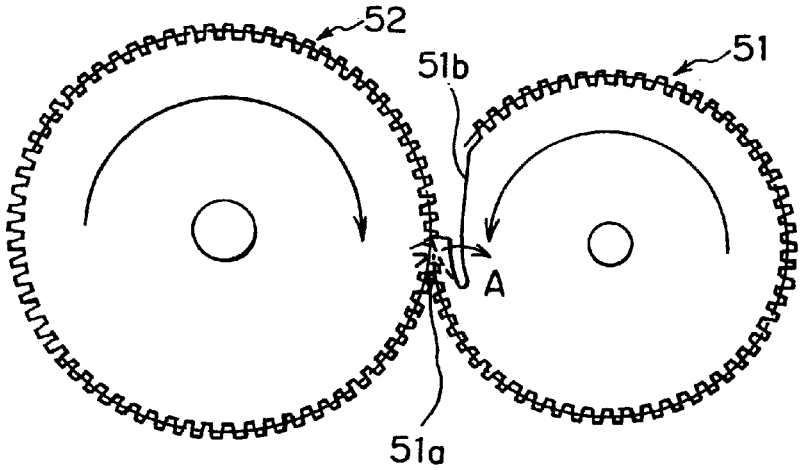
FIGS. 8B and 8C show the cut-out gear of FIG. 8A together with a driving gear.
Figure 8C:
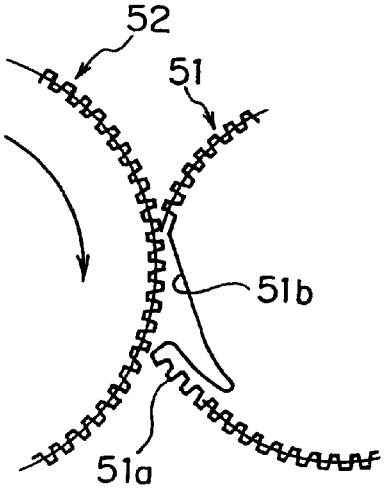

Referring to FIG. 8B, there is shown the cut-out gear 51 of FIG. 8A driven by a driving gear 52, with the overhang 51*a* in engagement with the driving gear 52 and bent thereby, before an interception of the engagement between the driving gear 52 and the cut-out gear 51 due to the lacking teeth part. As shown in FIG. 8B, the driving gear 52 rotates in the clockwise direction to drive the cut-out gear 51 in the counter-clockwise direction. After the engagement between the gears 51 and 52 passes the overhang 51*a* , the driving force from the driving gear 52 is intercepted due to the lacking teeth part 51*b*, and the overhang 51*a* recovers its original normal position by a spring function thereof.

The spring function of the overhang 51*a* prevents the teeth of the driving gear 52 from hitting the teeth on the overhang 51*a* continuously after the engagement is intercepted. As a result, the overhang is not damaged mechanically. The cut-out gear 51 is preferably made of a plastic material as by injection molding. The cut-out gear 51 may be used as the first gear section 21*a* or as the fourth gear section 21*d*. In the latter case, two of the combinations of the lacking teeth part 51*b* and overhang 51*a* may be provided.

Since the above embodiments are described only for examples, the present invention is not limited to the above embodiments and various modifications or alterations can be easily made therefrom by those skilled in the art without departing from the scope of the present invention.

What is claimed is:

1. A sheet feeder comprising:

a sheet loader for mounting thereon a pile of cut sheets, a pickup roller for transferring the cut sheets, a thrust member for intermittently thrusting the sheet loader and the pile of cut sheets against said pickup roller, a sheet feed roller for transferring the cut sheets transferred by said pickup roller, a feed motor, a coupling section for coupling said feed motor and said sheet feed roller for rotation of said sheet feed roller in forward and reverse directions and for intermittently coupling said feed motor and said thrust member for effecting said intermittent thrusting, wherein said thrust member comprises a first member, including a spring, for applying a thrust force for urging said sheet loader against said pickup roller, and a second member, including a cam, for releasing said sheet loader from said pickup roller against said thrust force applied to said first member, and wherein said coupling section comprises a sun-and-planet gear including a sun gear, idle gear and a planet gear, and a timing gear including a first gear section, having a first lacking teeth part, for intermittently receiving a forward driving force from said planet gear, a second gear section for receiving a reverse driving force from said idle gear, a third gear section for driving said cam, and a fourth gear section, having a second lacking teeth part, for driving said pickup roller.

2. A sheet feeder as defined in claim 1, wherein said fourth gear section further has a third lacking teeth part.

3. A sheet feeder as defined in claim 2, wherein at least one of said first and fourth gear sections has an overhang adjacent to said lacking teeth part, and said overhang has teeth thereon.

4. A sheet feeder as defined in claim 2, wherein said overhang has a spring function.

5. A sheet feeder comprising:

a sheet loader for mounting thereon a pile of cut sheets;

a pickup roller for transferring the cut sheets;

a thrust member for intermittently thrusting the sheet loader and the pile of cut sheets against said pickup roller;

a sheet feed roller for transferring the cut sheets transferred by said pickup roller;

a feed motor; and a coupling section for coupling said feed motor and said sheet feed roller for rotation of said sheet feed roller and for intermittently coupling said feed motor and said thrust member for effecting said intermittent thrusting, wherein said thrust member comprises a first member for applying a thrust force for urging said sheet loader against said pickup roller and a second member for releasing said sheet loader from said pickup roller against said thrust force applied by said first member, wherein said first member and said second member are implemented by a spring and a cam, respectively, and wherein said coupling section comprises a sun-and-planet gear including a sun gear, idle gear and a planet gear, and a timing gear including a first gear section, having a first lacking teeth part, for intermittently receiving a forward driving force from said planet gear, a second gear section for receiving a reverse driving force from said idle gear, a third gear section for driving said cam, and a fourth gear section, having a second lacking teeth part, for driving said pickup roller.

6. A sheet feeder as defined in claim 5, wherein said fourth gear section further has a third lacking teeth part.

7. A sheet feeder as defined in claim 6, wherein at least one of said first and fourth gear sections has an overhang adjacent to said lacking teeth part, and said overhang has teeth thereon.

8. A sheet feeder as defined in claim 6, wherein said overhang has a spring function.

* * * * *